US005590607A

United States Patent [19]

Howard

[11] Patent Number: 5,590,607

[45] Date of Patent: Jan. 7, 1997

[54] PORTABLE SHELF FOR NOTEBOOK COMPUTERS

[76] Inventor: Thomas E. Howard, 4730 Nelson St., Wheat Ridge, Colo. 80033

[21] Appl. No.: 299,832

[22] Filed: Sep. 1, 1994

[51] Int. Cl.[6] ..... A47B 57/00

[52] U.S. Cl. ..... 108/98; 108/167; 108/135; 248/231.71

[58] Field of Search ..... 108/152, 43, 47, 108/46, 98, 32, 64, 65, 97, 128, 167, 166, 134, 135; 248/231.71, 291.1, 217.1, 231.31, 316.2

[56] References Cited

U.S. PATENT DOCUMENTS

| | | | |
|---|---|---|---|
| D. 314,505 | 2/1991 | Chen | D6/512 |
| 367,259 | 7/1887 | Witek . | |
| 606,514 | 6/1898 | Carrier | 108/32 X |
| 895,834 | 8/1908 | Aungst . | |
| 1,223,637 | 4/1917 | Swain | 108/97 X |
| 1,282,489 | 10/1918 | Strodel | 108/135 X |
| 2,201,598 | 5/1940 | Towler | 108/135 |
| 2,212,286 | 8/1940 | Boyd | 108/135 X |
| 2,324,570 | 7/1943 | Figgins | 155/133 |
| 2,593,222 | 4/1952 | Tracy | 248/231.7 |
| 2,905,423 | 9/1959 | Smith et al. | 248/231.7 |
| 2,922,683 | 1/1960 | Schmertz | 108/134 X |
| 3,083,482 | 4/1963 | Lange et al. | 108/135 X |
| 3,133,760 | 5/1964 | Robinson | 297/174 |
| 3,143,086 | 8/1964 | Turner et al. | 108/166 X |
| 3,586,284 | 6/1971 | Ricbold | 248/231.71 X |
| 3,647,078 | 3/1972 | Fortunato | 211/134 |
| 4,312,535 | 1/1982 | Smith | 297/174 |
| 4,506,928 | 3/1985 | Marion | 297/174 |
| 4,562,987 | 1/1986 | Leeds et al. | 248/278 |
| 4,568,120 | 2/1986 | Hoffman | 297/174 |
| 4,583,753 | 4/1986 | Economy | 280/33.99 |
| 4,836,486 | 6/1989 | Vossoughi et al. | 248/281.1 |
| 4,844,387 | 7/1989 | Sorgi et al. | 248/1 F |
| 4,973,176 | 11/1990 | Dietrich | 400/715 |
| 5,082,235 | 1/1992 | Crowther et al. | 248/918 |
| 5,104,080 | 4/1992 | Berger | 248/250 |
| 5,106,156 | 4/1992 | Marquis | 108/43 X |
| 5,119,742 | 6/1992 | Simmie | 108/46 |
| 5,129,715 | 7/1992 | Maynard, Jr. | 312/351.9 |
| 5,140,914 | 8/1992 | Bohbot et al. | 108/44 |
| 5,156,096 | 10/1992 | Lamprey | 108/152 |
| 5,205,222 | 4/1993 | Bernard | 108/42 X |
| 5,277,392 | 1/1994 | Rossman et al. | 248/231.7 |
| 5,288,042 | 2/1994 | Grimm | 248/118 |
| 5,295,650 | 3/1994 | Brandt | 108/26 X |

FOREIGN PATENT DOCUMENTS

| | | | |
|---|---|---|---|
| 940114 | 4/1948 | France | 108/26 |
| 1242268 | 8/1960 | France | 248/231.7 |
| 631247 | 5/1936 | Germany | 108/97 |
| 663644 | 8/1938 | Germany | 108/32 |

OTHER PUBLICATIONS

Advertisement for The Laptop Desk from the American Business Concepts, Inc. Dec. 5, 1993.

*Primary Examiner*—Peter M. Cuomo
*Assistant Examiner*—Janet M. Wilkens
*Attorney, Agent, or Firm*—John E. Reilly

[57] ABSTRACT

A portable shelf apparatus for a notebook computer adapted to be mounted on a stationary body such as a table having an edge in which a pair of folding supports each includes an elongated support arm and a hanger for suspending the support from the edge, the hanger and arm are joined by a support hinge, and a deck having opposite ends attached to the support arms for supporting the notebook computer thereon. Each end of the deck is either foldably attached to one of the support arms by an end hinge or slidably attached via a tongue and groove joint. The deck may also include at least two folding leaves joined by a central buttress hinge. The hanger is a generally U-shaped support device having an upper suspension member and a lower stabilizer member and an opening therebetween for receiving the table edge. The lower stabilizer member includes a rod slidably supported in a first bore through the lower stabilizer member with one end extending into the opening toward the upper suspension member and a cam in the lower stabilizer fixes the position of the rod in the lower stabilizer member.

39 Claims, 3 Drawing Sheets

PORTABLE SHELF FOR NOTEBOOK COMPUTERS

BACKGROUND AND FIELD OF INVENTION

This invention generally relates to shelf support devices and more particularly to a portable shelf for supporting a laptop or notebook computer from a surface such as a table at a convenient operating position.

A number of approaches have been offered for supporting objects from a horizontal surface such as a table, bench or desk. For example, U.S. Pat. Nos. 2,324,570; 3,133,760; 4,312,535; 4,506,928; and 4,568,120 disclose detachable baby chairs and backs for benches which can be readily installed and removed from tables or benches. U.S. Pat. Nos. 4,562,987; 4,836,486; 4,844,387; 5,277,392; Design Pat. No. 325,868 and Design Pat. No. 314,505 all disclose various table or desk mounted supports for computer terminals or monitors. Wrist supports are disclosed in U.S. Pat. Nos. 4,973,176 and 5,288,042. A mouse support for hanging a flat mouse pad on a desk or table is disclosed in U.S. Pat. No. 5,119,742. Other representative general support devices are disclosed in U.S. Pat. Nos. 895,834; 3,647,078; 4,583,753; 5,082,235; 5,104,080; 5,129,715; 5,140,914; and 5,156,096.

For desk top computers, as opposed to notebook and laptop designs, there is a wide variety of special furniture and appurtenances commercially available to take care of most ergonomic problems. Desks and work tables incorporate such features as built in shelves or drawers that accommodate the keyboard at a proper typing height. However, no analogous solution has been heretofore presented for the user of the notebook or laptop computer except for a stand-alone stationary desk system which has a floor supported printer stand, book shelf, light, and an inclined reading table surface specifically designed to accommodate a notebook computer. This stand-alone system, marketed by American Business Concepts, Inc. is not portable in any sense, although it is on wheels so that it can be rolled around a room.

Throughout this specification, reference to notebook computers will be understood to include laptop computers. Notebook and laptop computers available today are primarily designed for compactness and for limited use while the user is commuting or traveling away from the user's primary desktop computer. Notebook computers are generally a bit smaller than laptops. Typically, these computers are supported on the user's lap while traveling. A person's lap is ideal for holding small children,and for the adept, can be used as an eating platform at picnics and buffets. However, a person's lap is not a practical surface on which to perform serious sustained work other than such activities as knitting or fine sewing. A person's lap is also not a good support for sustained use of a notebook computer. Therefore, most computer users place their notebook computers on a horizontal surface of some stationary object, such as, a table top or desk for sustained use, whenever available.

There are a number of ergonomics problems confronted by the user of a notebook computer when the user is at a desk or table or in some other location that is not as confining as a car or an aircraft seat. For example, the standard table or desk top is at a height of between about 28 and 30 inches. This height is comfortable for writing with a pencil or pen, but is too high for comfortable use of a keyboard for sustained periods. In addition, the notebook computer keyboard is usually flat and compact, so that it is not at an ergonomically correct angle. Further, there is usually no rest for the user's wrist which can lead to joint problems, such as, carpal tunnel syndrome over prolonged use in incorrect positions.

There is presently an unfilled need for a compact, portable shelf for supporting a laptop or notebook computer from a stationary object, such as, a table or desk at a height, angle and position that is ergonomically correct for the user.

SUMMARY OF THE INVENTION

It is therefore an object of the present invention to provide for a novel and improved portable shelf for a notebook computer that fulfills the aforementioned needs.

It is another object of the invention to provide for a novel and improved portable shelf that is compact and readily transportable in a standard briefcase along with the notebook computer.

It is a further object of the invention to provide a portable shelf for a notebook computer that is simple to install and remove from the support object.

It is a still further object of the present invention to provide a portable shelf which is conformable for mounting on different stationary objects.

It is a still further object to provide a portable shelf which is foldable and/or may be knocked down into a compact portable package.

It is a still further object of the invention to provide a portable shelf for a notebook computer that can accommodate a variety of accessories, such as, a document support, a mouse support, and cable routing hanger.

The portable shelf apparatus for supporting a notebook computer in accordance with the present invention can be attached to a stationary body, such as, an edge of a standard desk, table or shelf in such a manner that it provides a cantilevered platform. The apparatus basically comprises at least one hanger extending from an edge of the desk and includes means for releasably engaging the stationary body for downward inclination of the deck at an ergonomically beneficial angle. The apparatus preferably comprises a pair of foldable supports each including an elongated support arm and a hanger for attaching the support to an edge of a table or other stationary body. The hanger and support arm may be rigid but are preferably joined by a support hinge. The advantage of this arrangement is that the shelf can be equipped with different hanger configurations depending on the intended installation simply by removing the hinge pin and installing a different hanger. The shelf apparatus also includes a deck having a generally flat upper surface and having opposite ends attached to the support arms for supporting the notebook computer thereon.

The hanger is a generally U-shaped clasping device which has an upper suspension member and a lower stabilizer member and a space therebetween for receiving the edge of the table or other object. The lower stablizer member includes an elongated member such as a rod slidably supported in a first bore through the lower stablizer member with one end of the rod extending into the space between the jaws toward the upper suspension member. The position of the rod can be easily adjusted to size the space between the end of the rod and the upper suspension member appropriately to clasp the edge of the table therebetween. A cam operated locking device in the lower stablizer member is used to manually lock the rod in a fixed position.

The locking device includes a spring biased cam rotatably supported in the lower stablizer member. The device is operable between a spring biased first position engaging the rod to hold the rod in a fixed position in the lower stablizer member and a second position disengaged from the rod permitting sliding adjustment of the position of the rod. The cam is rotatably supported in a cavity in the lower stablizer member on a shaft in a second through bore. This cavity intersects with the first bore through which the rod slides. One or both ends of the shaft include an actuating lever or handle for the user to lift or press to rotate the cam. The cam is spring biased into engagement with the rod so that the rod stays in position when the handle is released. By raising the handle, the cam is forced against the rod to lock it in position. By depressing the handle, the cam is released, permitting the rod to slide up and down in the first bore.

The shelf in accordance with the invention also includes a generally rectangular computer support deck which has opposite ends supported by the support arms. The support deck may be a single piece or may be made up of at least two leaves joined by a suitable joint or hinge. In addition, the deck may be joined to each of the support arms by means of one or more hinges or a removable fixed joint such as a complementary sliding tongue and groove arrangement. Each of the support arms may also have a provision to support a document holder or extension platform or other accessory such as a mouse or cord holder adjacent to the deck.

In the preferred embodiment, the deck is made up of two folding leaves which are hinged together by a central buttress hinge. The leaves are also hinged to the support arms by end hinges which are parallel to the central hinge. The hinges fold open in opposite rotational directions. When open, this arrangement provides a secure, rigid, flat, inclined surface for support of the notebook computer and accessories which can be attached to a table quickly and easily without tools. In addition, the whole assembly can be folded into a neat, portable package of about 12"×4"×6" which can easily be carried in most briefcases along with a notebook.

A second, alternative embodiment differs in that the deck is joined to each of the support arms by a sliding tongue and groove joint. This arrangement permits the portable shelf to be carried as separate pieces in narrower or smaller briefcase that cannot accommodate the folded package dimensions. In addition, this arrangement permits different designs of hangers to be quickly substituted depending on the type of object that the shelf is to be installed on. For example, a hanger with an adjustable hook or adjustable throat may be provided for installation in a factory or on warehouse shelving. In this alternative embodiment, the deck may be one piece or it may be made of two leaves joined together, such as, by a central buttress hinge, and the leaves are in turn joined to the support arms by the sliding tongue and groove joints.

In both embodiments, the support arms fold down from the hangers by the support hinges. The lower portion of the lower stablizer member of the hanger is preferably beveled so that the end of the support arm abuts against the lower stablizer member of the hanger at an angle of between about 3° and 10° and preferably about 5° from the longitudinal axis of the lower stablizer member which, for table installations, should be parallel to the table surface. This angle is ergonomically desirable for computer keyboards used by most people and is sorely lacking from most notebook computers due to their small package size.

The portable shelf of the present invention particularly solves a number of ergonomic problems presented by most notebook computers. Notebook computers are small in footprint and have flat, compact keyboards. They are designed primarily for use in tightly confined spaces such as an airplane seat. When a user attempts to use these notebook computers in the hotel or at home, the user is typically sitting at a desk or a table. In such cases, the notebook computer is placed on the desk at an undesirable height and angle, such that continued use becomes extremely uncomfortable. In addition, there is no wrist rest which can be instrumental in preventing carpal tunnel syndrome.

The portable shelf of the present invention solves these problems by providing a work surface at a correct position and accessory support devices in the correct locations for efficient use. These and other objects, features, and advantages of the present invention will become more apparent from a reading of the following detailed description of the invention when taken in conjunction with the accompanying drawing in which:

DETAILED DESCRIPTION OF PREFERRED EMBODIMENT

Figure 1:
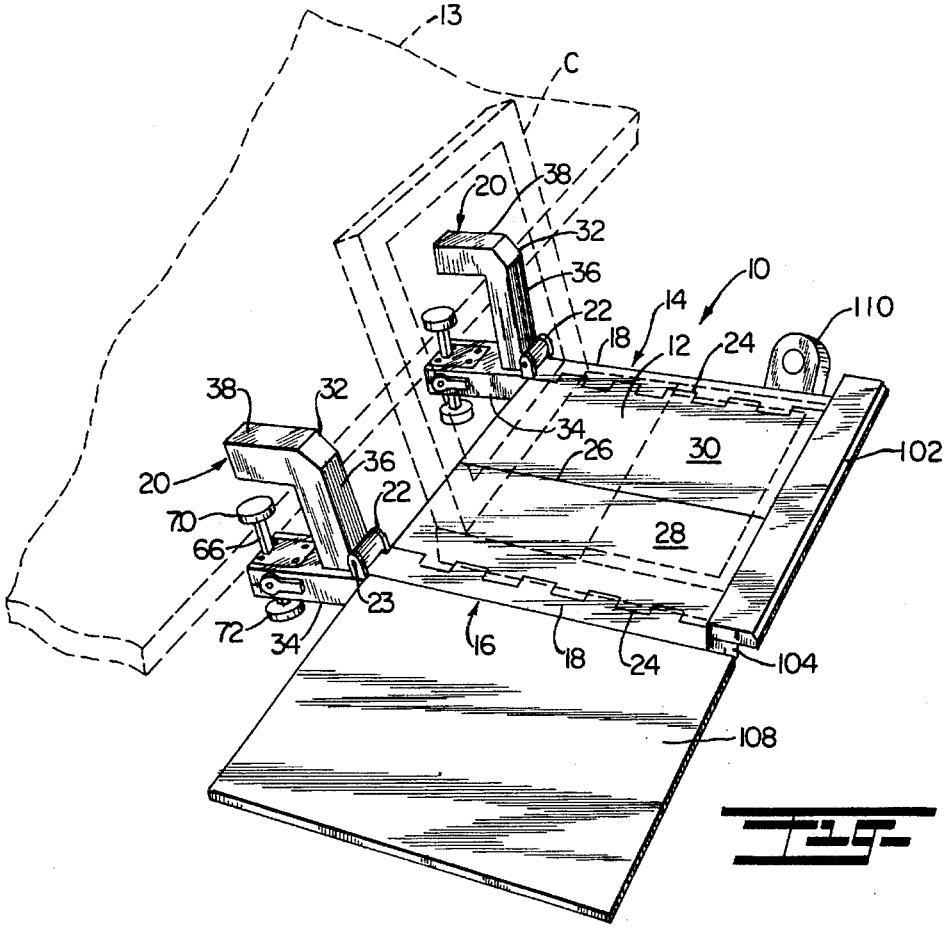
FIG. 1 is a perspective view of a preferred embodiment of the present invention attached, in phantom, to the edge of an object such as a table, and showing the relative position of a notebook computer in phantom.

Turning now to the drawings, a perspective view of the portable shelf according to the present invention is shown in FIG. 1 with a notebook computer C, shown in phantom, resting on a deck 12 of the shelf apparatus 10. The portable shelf apparatus 10 is attached to the edge of a tabletop 13 in FIG. 1.

The shelf apparatus 10 comprises the deck 12 and a pair of foldable supports 14 and 16, each including an elongated support arm 18 and a hanger 20. The hanger 20 and the support arm 18 are joined by a support hinge 22. The support hinge 22 may have a removable pin 23 so that different hangers to be subsequently described may be interchangeably installed onto the support arms 18.

As shown in FIG. 1, each of the support arms 18 is joined to a deck 12 by an end hinge 24. The deck 12 also has a central buttress hinge 26 dividing the deck 12 into a left leaf 28 and a right leaf 30, best shown in FIGS. 3 and 4. Alternatively, the deck 12 may be a single flat structure having a generally flat upper surface with the opposite ends forming end hinges 24.

Figure 5:
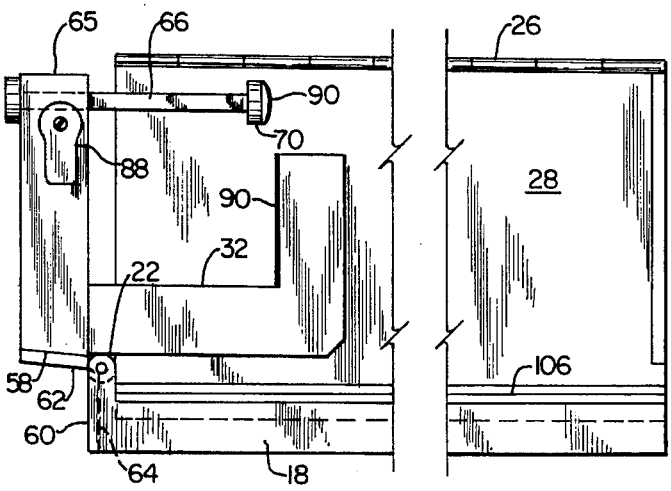
FIG. 5 is a folded side view of the preferred embodiment of the portable shelf in accordance with the invention.
Figure 6:
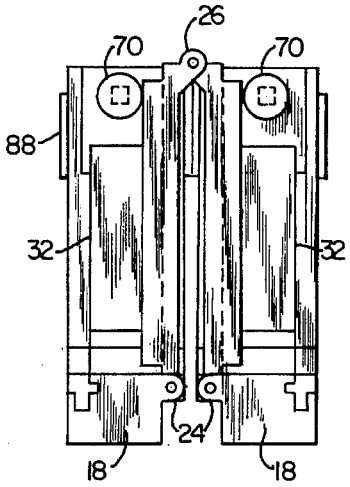
FIG. 6 is a right end view of the folded shelf shown in FIG. 5.

The central hinge 26 is a buttress hinge permitting leaves 28 and 30 to be folded in opposite directions about the axis of the hinge 26 to a position in which the leaves are parallel to each other, as shown in FIGS. 5 and 6, and opened to a fully open position where the leaves 28 and 30 are butted together, forming a planar upper deck surface.

Figure 2:
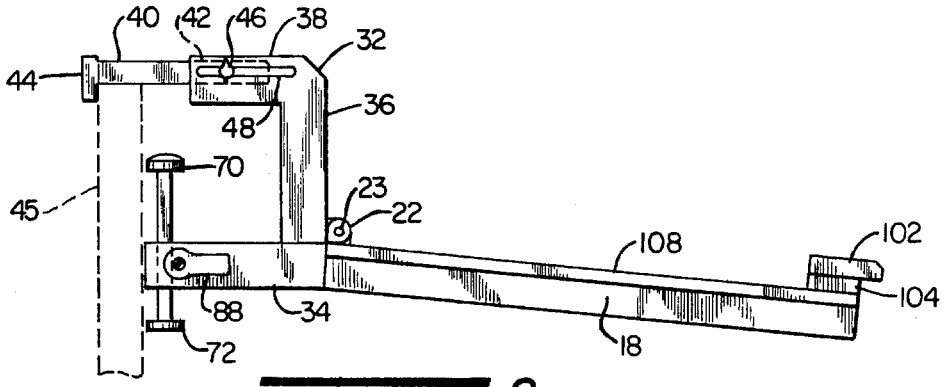
FIG. 2 is a side view of the portable shelf of the present invention shown in FIG. 1 with an alternate form of hook hanger.

Each of the hangers 20 is a generally U-shaped device that is designed to hook or releasably clasp onto a variety of surfaces such as a table top or a desk top and can be adjusted to accommodate a variety of thicknesses. The hanger 20 has a generally L-shaped upper suspension member 32 which is permanently affixed to a lower stablizer member 34. The upper suspension member 32 includes a riser portion 36 and a leg portion 38 extending generally parallel to the lower stabilizer member 34. The leg portion 38 of the upper suspension member 32 may be a solid piece as shown in FIGS. 1 and 3 through 8, or may alternately be adjustable as is shown in FIG. 2. In FIG. 2, the upper suspension member 32 includes an adjustable hook 40 which extends out of a socket 42 in the leg portion 38. The adjustable hook 40 preferably includes a hook-shaped end 44 to permit the hanger 20 to be hooked over a vertical shelf or rack 45 as is shown in phantom in FIG. 2. The position of the adjustable hook 40 is secured in relation to the leg portion 38 by tightening a wing bolt 46 riding in a slot 48 in the socket 42.

Figure 11:
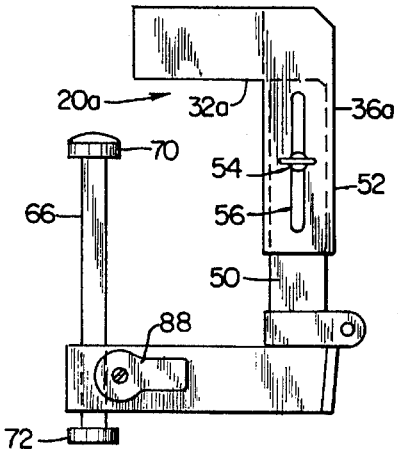
FIG. 11 is a side view of an alternate hangar in accordance with the present invention.

The distance between the lower stabilizer member 34 and the leg portion 38 of the upper suspension member 32 may also be made adjustable with the alternate hanger 20A shown in FIG. 11. In this alternative design, the hanger 20A has an adjustable throat in the riser portion 36A of the upper suspension member 32A. Riser portion 36A is comprised of a riser pin 50 which is slidably disposed in a riser socket 52. Relative position of riser pin 50 in riser socket 52 is fixed by a wing bolt 54 which rides in a slot 56 in the socket 52. This adjustable throat hanger design is particularly adapted to use in industrial locations such as a warehouse where a shelf 10 is required to fit on a relatively thick object. Similarly, the adjustable hook design previously described is particularly adapted for hanging the shelf 10 from a vertical edge or lip of a piece of equipment in a factory setting. Upper suspension members and lower stabilizer members 32 and 34 in these embodiments may be made of a single piece of metal, wood or other material, or may be suitably joined with a strong, fixed joint.

Referring again to FIGS. 2 and 5, the hanger 20 is joined to the support arm 18 by a support hinge 22 at the juncture of the riser portion 36 of the upper suspension member 32 and the lower stabilizer member 34. The front end surface of the lower stabilizer member immediately below the support hinge 22 has a beveled face 58 which is designed to butt against the rear face 60 of the support arm 18. The support hinges 22 between the hangers 20 and support arms 18 serve two important functions. First, they allow shortening of the support assembly to a convenient length for carrying when folded. Second, by simply beveling the face 58, the support arm 18 can be inclined to tilt the deck at a comfortable angle for typing. The face 58 is beveled so that the longitudinal axis of the support arm 18 makes an angle of about 5° with the longitudinal axis of the lower stablizer member 34. Because most shelf installations will be on a horizontal surface, such as, a table, the lower stabilizer member 34 will be parallel to the upper surface of the table. Accordingly, the 5° bevel provides a 5° tilt to the deck 12 in order to provide an ergonomically satisfactory tilt to the installed deck 12.

The beveled face 58 has a vertical tongue 62 centrally disposed beneath the hinge 22 as shown in FIG. 5. The rear face 60 of the support arm 18 has a complementary vertical groove 64, when mated together in the open position. The tongue 62 and groove 64 are torsion bearing in relation to the support hinge 22. This arrangement prevents torsional movement of the hangers 20 and arms 18 when an accessory is installed outboard of the shelf 10.

The rear end 65 of the lower stabilizer member 34 of the hanger 20 includes a rod 66 which extends through a first vertical bore 68 through the rear end 65 of the lower stabilizer member 34. See FIGS. 9 and 10. The rod 66 is preferably of square cross-section and has an upper end cap 70 covered with a resilient pad mounted on one end toward the upper suspension member 32 and a stop cap 72 fixed to the opposite end of the rod 66 to retain the rod 66 in the first bore 68.

Figure 9:
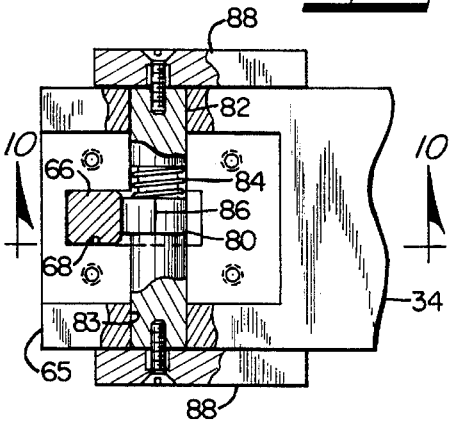
FIG. 9 is an enlarged partial top view of the lower stablizer member of the hanger in accordance with the present invention with portions broken away to reveal the locking device.
Figure 10:
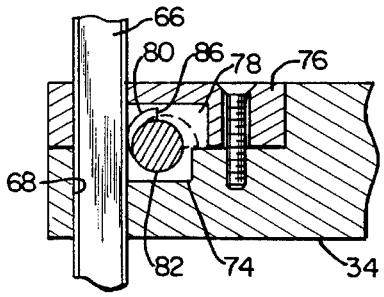
FIG. 10 is a sectional view taken along the line 10—10 in FIG. 9 of the lower hanger stablizer member.

As best shown in FIGS. 9 and 10, the rear end 65 of the lower stabilizer member 34 has a recessed seat 74 which receives a cam shaft bearing cap 76, and forms an inner cavity 78 beneath the cap 76. The cavity 78 receives the cam 80 and is in communication with the first bore 68. The cam 80 is fixed to a shaft 82 journaled in a second transverse bore 83 which passes horizontally through the lower stabilizer member 34 and the cavity 78.

The cam 80 is rotatable between a position biased against the rod 66 and a position in which the eccentric lobe of the cam 80 is rotated out of engagement with the rod 66 as shown by the dashed line in FIG. 10. The cam 80 is maintained in contact with the rod 66 by cam-biasing spring 84, shown in FIG. 9. The cam-biasing spring 84 is a coiled spring having one end abutting the face 86 of the cam 80 and the other end engaged with either the cam shaft bearing cap 76 or a wall of the cavity 78 such that a continual torque is placed on the cam 80 to maintain it in biased engagement with the rod 66.

A locking handle or lever 88 is fixed to each end of cam shaft 82 and operates the cam 80 between a spring-biased first position which engages the rod 66 to hold the rod in position with the lower stabilizer member 34 and a released second position, as shown by the dashed lines in FIG. 10, in which cam 80 is disengaged from the rod 66. By pressing down on the handle 88, the cam 80 is disengaged. By lifting up on the handle 88, the cam 80 engages the rod 66 and can be wedged against it in the first position thereby locking the rod.

The underside of the leg 38 of the upper suspension member 32 and the upper surface of the swivel cap 70 is preferably covered with a layer 90 of rubber or other resilient material which has a high coefficient of friction. This covering material is designed to protect the furniture upon which the shelf is mounted and also to provide resistance to sliding.

Installation of the portable shelf 10 in accordance with the present invention on a typical table top 13 is extremely simple and fast. The folded apparatus is unfolded so that the deck 12 and the supporting arms 18 form a flat planar surface. The locking levers 88 are depressed, rotating the cams 80 out of engagement with the rods 66, allowing them to fall, providing a maximum opening between the upper suspension members and lower stabilizer members of the hanger 20. The legs 38 of the hangers 20 are then placed over the edge of the table top. The rods 66 are then raised into engagement with the underside surface of the table top with finger pressure on the stop cap 72. Each cam locking lever or handle 88 is then rotated upward, wedging the cam 80 into engagement with the rod 66 to lock it in position.

One merely depresses the locking levers 88 in order to remove the shelf in accordance with the present invention which allows the rods 66 to slide down, and the hangers 20 of the shelf unit 10 are lifted off of the table top or other object to which they were suspended. The left and right leaves 28 and 30 then can be folded down, and the left and right support arms 18 folded up and the hanger 20 folded over the support arm 18 to the folded position in closely spaced, parallel relation to the deck leaves 28 and 30, as shown in FIGS. 5 and 6, for storage or transport.

It should be noted that, during folding and unfolding, central hinge 26 and end hinges 24 are rotated in opposite directions. For example, during folding, right leaf 30 is rotated clockwise around central hinge 26 and right support arm 18 is rotated counterclockwise about end hinge 24 to the folded position shown in FIG. 6. Similarly, left leaf 28 is rotated counterclockwise around central hinge 26 while left support arm 18 is rotated clockwise around left end hinge 24 through the folded position. The axes of central hinge 26 and the end hinges 24 are parallel with each other. The support hinges 22 on the other hand are orthogonal to the axes of the central and end hinges 26 and 24, respectively, so that the hanger 20 can be folded toward the support arms 18 to shorten the overall folded package. The folded package shown in FIGS. 5 and 6 is approximately 12" long by 4" wide by 6" high.

Figure 3:
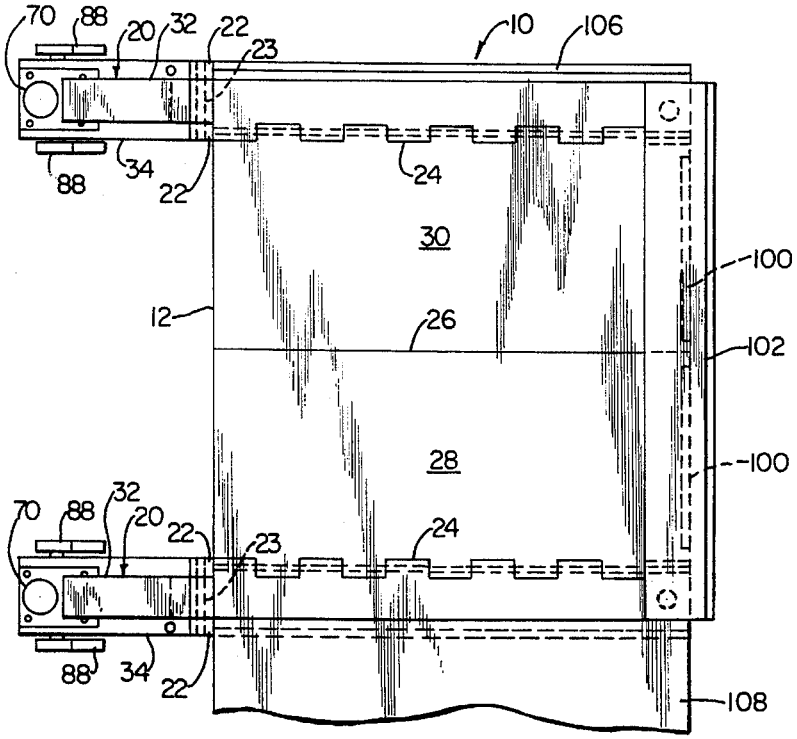
FIG. 3 is a top view of the shelf shown in FIG. 1.
Figure 4:
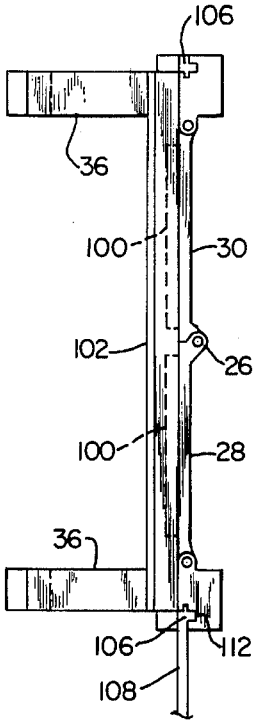
FIG. 4 is a front end view of the shelf shown in FIG. 3.

Referring now to FIGS. 1 through 3, an upwardly extending rib 100 along the front edge of the leaves 28 and 30 is provided to prevent the notebook computer from sliding off of the deck 12. The shelf 10 in accordance with the present invention may also include a removable wrist rest 102 which is removably pinned to both right and left support arms 18 by a dowel and bushing 104 at each end of the wrist rest 102. The wrist rest 102 may be positioned at various heights above the deck 12 by different sized dowels and bushings 104. This accommodates various sizes or thicknesses of notebook computers. When the wrist rest 102 is installed, the rib 100 is covered and is non-functional. Its function is taken over by the wrist rest 102.

Each of the support arms 18 preferably encloses a pair of intersecting grooves 106 along the outside edges of each support arm. These intersecting grooves 106 are designed to receive accessory devices, such as, a shelf extension 108 or track ball 110. An accessory such as the shelf extension 108 is a flat planar surface and a pair of orthogonal tongues 112 extending along one edge which are shaped complementary to the intersecting longitudinal grooves 106. This arrangement provides a sliding interlocking tongue and groove joint between the shelf extension 108 and the support arm 18. Other accessory devices may also be positioned in the grooves 106, such as, an L-shaped copy holder or cable keeping retainer which have corresponding orthogonal tongues.

DETAILED DESCRIPTION OF MODIFIED FORM OF INVENTION

Figure 7:
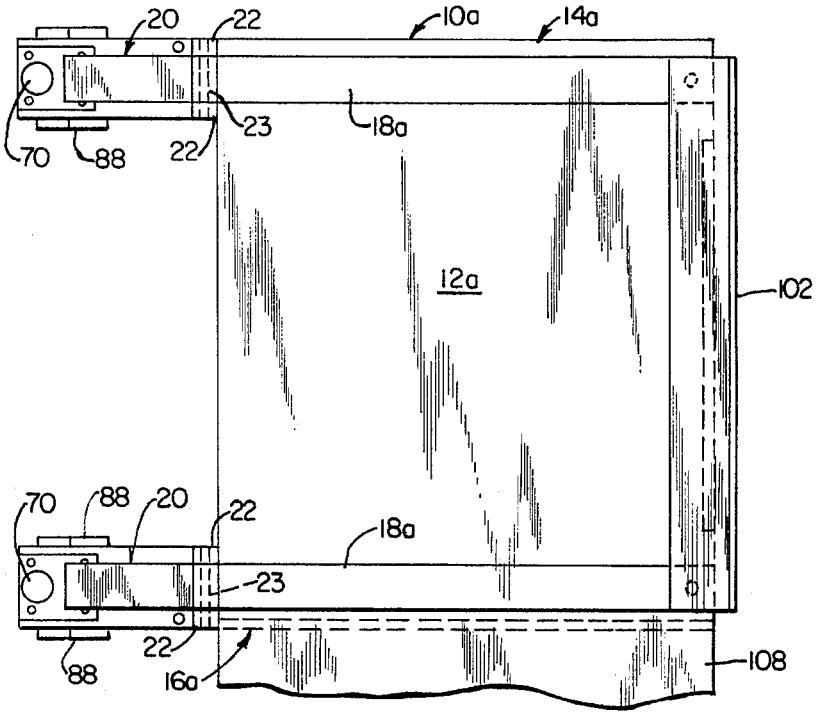
FIG. 7 is a top view of a modified embodiment of the shelf in accordance with the present invention.
Figure 8:
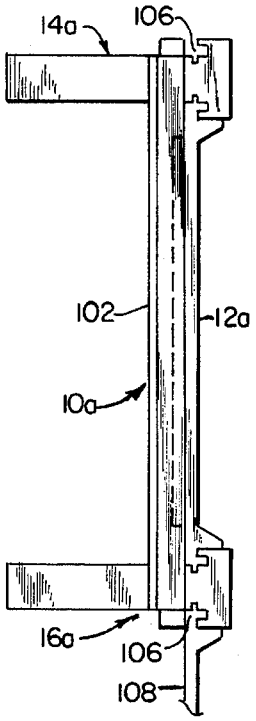
FIG. 8 is a front view of the shelf shown in FIG. 7.
Figure 12:
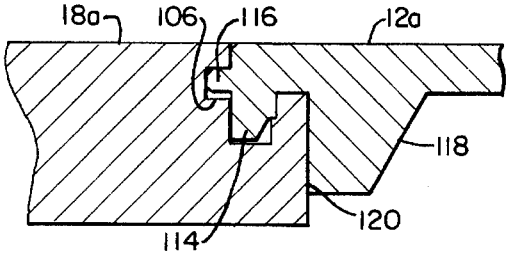
FIG. 12 is an enlarged partial cross sectional view of the joint between the support arm and the deck shown in FIGS. 7 and 8.

An alternative "knock-down" embodiment of the shelf apparatus 10*a* is illustrated in FIGS. 7, 8 and 12. This embodiment is identical to the first embodiment just described except for the joinder between the deck and the support arms. Accordingly, like numbers will be utilized where possible. The shelf assembly 10*a* in accordance with this alternative embodiment is shown in plan view in FIG. 7 and in a front end view in FIG. 8. The shelf assembly 10*a* includes a deck 12*a* which is supported by folding supports 14*a* and 16*a*. Folding supports 14*a* and 16*a* are made up of a hanger 20 as above described with reference to the preferred embodiment and a support arm 18*a* which are joined together by a support hinge 22. The support arm 18*a* is an elongated, generally rectangular member having a flat upper surface and a pair of intersecting longitudinal grooves 106 extending in parallel along both the inside and outside upper corners of each of the support arms 18*a*.

The deck 12*a* may be a single piece of material or may be a pair of hinged leaves as in the first embodiment. However, the opposite lateral ends of deck 12*a* include a first downwardly extending tongue 114 along the end and a second tongue 116 extending outwardly from the first tongue 114 complementary to the intersecting grooves 106 in the support arm 18*a*. The deck 12*a* is installed onto the support arms 18*a* by sliding the tongues 114 and 116 into the interlocking grooves 106 to form a rigid interlocking tongue and groove joint. An enlarged view of this joint is shown in FIG. 12. In addition to the interlocking tongue and groove joint, a downwardly extending buttress support 118 is provided along the underside of the deck 12*a* spaced forward behind the tongue 116 which butts against the side 120 of the support arm 18*a*. The support 118 adds rigidity to the joint and overall structure of the shelf 10*a*.

A shelf extension 108, or other accessory, may also be installed in the remaining pair of intersecting grooves 110 on the outside upper corners of the support arm 18, as shown in FIGS. 7 and 8.

The shelf apparatus in accordance with the present invention has been shown and described with reference to certain preferred embodiments in an illustrative manner. It is to be understood that the terminology which has been used is intended to be in the nature of words of description rather than of limitation. For example, the positioning rod 66 rather than being an essentially square cross-section rod, may have a round cross-section with a flat side milled along its length. Obviously, many other modifications and variations of the present invention are possible in light of the above teaching. For example, it will be evident that the deck 12 may be of solid platform construction or simply a skeleton in the form of an open frame support member. It is therefore to be understood that within the scope of the appended claims the invention may be practiced otherwise than as specifically described. All patents, patent applications and publications referred to herein are hereby incorporated by reference in their entirety.

I claim:

1. A portable shelf apparatus for releasably suspending a notebook computer from a stationary body, comprising:

a substantially flat support member for supporting said notebook computer; and at least one hanger extending from an edge of said support member including cantilever suspension means for releasably engaging said stationary body for downward inclination of said support member from a point beneath said edge at a predetermined angle away from said stationary body, said suspension means including an upper suspension member and a lower stabilizer member with an elongated member slidable therein in vertically spaced confronting relation to one another and defining the only suspension members for suspension of said support member from and beneath said edge of said stationary body so as not to interfere with a computer user's legs in assuming a typing position with the legs extending beneath said support member.

2. The apparatus according to claim 1, wherein said hanger has an end face bearing against an end of said support member to define an included angle therebetween which will suspend said support member at an angle of between about 3° and 10° below a horizontal plane.

3. The apparatus according to claim 2, further comprising a pair of hangers extending from an edge of said support member.

4. The apparatus according to claim 3, wherein each of said hangers includes said upper suspension member for hanging from a portion of said stationary body and said lower stabilizer member for resting against said body and having a space therebetween for receiving said portion of said body.

5. The apparatus according to claim 4, wherein said angle is about 5°.

6. The apparatus according to claim 1, wherein said upper suspension member is adapted to bear against an upper surface portion of said stationary body and said lower stabilizer member is aligned beneath said upper suspension member and is adapted to bear against an undersurface portion of said stationary body, and a space therebetween for receiving a portion of said stationary body.

7. The apparatus according to claim 1, wherein said lower stabilizer member further comprises a locking device for fixing the position of said elongated member in said lower stabilizer member.

8. The apparatus according to claim 7, wherein said hanger is foldably attached to said support member.

9. A portable shelf apparatus for a notebook computer adapted to be mounted on a stationary body having an edge, said apparatus comprising:

at least one foldable support including an elongated support arm and a hanger for suspending said support from said edge, said hanger and arm being joined by a support hinge and said hanger having an upper suspension member adapted to bear against an upper surface portion of said body to define a bearing surface of engagement therebetween, a lower stabilizer member, and an opening between said suspension member and said stabilizer member for receiving said edge, said stabilizer member including an elongated member slidably supported in a first bore through said stabilizer member, said elongated member having one end extending into said opening toward said upper suspension member for adjusting the space between said upper suspension member and said one end of said elongated member, said end of said elongated member adapted to bear against an undersurface portion of said body at a location on said undersurface portion further removed from said edge than said bearing surface of engagement; and a deck having a generally flat upper surface for extension from and beneath said edge, said deck attached to said support arms for supporting said notebook computer thereon.

10. The apparatus according to claim 9, wherein a locking device in said lower stabilizer member for fixing the position of said elongated member in said lower stabilizing member includes a spring biased cam rotatably supported in said lower stabilizer member operable between a first position engaging said elongated member to lock said elongated member in a fixed position in said lower stabilizer member and a second position disengaged from said elongated member permitting sliding adjustment of said elongated member between said lower stabilizer member and said upper suspension member.

11. The apparatus according to claim 10, wherein said elongated member is a generally cylindrical rod having at least one flat side.

12. The apparatus according to claim 11, wherein said rod has a generally rectangular cross-section.

13. The apparatus according to claim 10, wherein said cam is rotatably supported in a second bore in said lower stabilizer member communicating with said first bore.

14. The apparatus according to claim 10, wherein said cam is spring-biased into engagement with said elongated member, said cam including an actuating handle fixedly attached to one end of said cam and extending out of said lower stabilizer member for manually disengaging said cam from said elongated member.

15. The apparatus according to claim 14, wherein said elongated member is a generally cylindrical rod having at least one flat side.

16. The apparatus according to claim 15, wherein said rod has a generally rectangular cross-section.

17. The apparatus according to claim 16, wherein said cam is rotatably supported in a second bore in said lower stabilizer member communicating with said first bore.

18. The apparatus according to claim 17, wherein said support hinge is attached between said support arm and said lower stabilizer member of said hanger, an end portion of said arm abutting a portion of said lower stabilizer member when said support hinge is in an open position.

19. The apparatus according to claim 18, wherein said portion of said lower stabilizer member is beveled so that said arm extends from said hanger at an angle of between about 3° and 10° from a longitudinal axis through said lower stabilizer member.

20. The apparatus according to claim 19, wherein said elongated member has an enlarged cap on said upper end of said elongated member.

21. The apparatus according to claim 20, wherein said cap on said upper end of said elongated member and an underside of said upper suspension member are covered with a high friction cushion material to grip and prevent marring of said edge of said body.

22. A portable shelf apparatus for a notebook computer adapted to be suspended from a stationary body having an edge, the apparatus comprising:

a pair of foldable supports each including an elongated support arm and a hanger for attaching the support to said edge, and a support hinge between said hanger and said arm; and a deck having a generally flat upper surface and having opposite ends attached to said support arms for supporting said notebook computer thereon, and an end hinge attached between each end of said deck and one of said support arms operable through an arc of 90° between a folded position wherein an upper surface of said support arm is at a right angle to said upper surface of said deck and an open position wherein said upper surface of said support arm and said upper surface of said deck lie in a common plane.

23. The apparatus according to claim 22, wherein said deck includes a pair of deck leaves and a central buttress hinge joining said leaves, said central buttress hinge being operable between an open position wherein said leaves form a flat planar support surface with said leaves abutted together and a folded position wherein said leaves are parallel to each other.

24. The apparatus according to claim 23, wherein said end hinges and central hinge are rotated in opposite directions in order to move between said folded and open positions.

25. The apparatus according to claim 24, wherein said end hinges and said central buttress hinge rotate about parallel axes.

26. The apparatus according to claim 25, wherein said support hinge between said hanger and said support arm is rotatable about an axis orthogonal to said end hinge.

27. A portable shelf apparatus for a notebook computer adapted to be suspended from a stationary body having an edge, said apparatus comprising:

at least one foldable support including an elongated support arm, a hanger for suspending said support from said edge, and first hinge means for foldably joining said hanger and said arm together and providing a support for said arm against a portion of said hanger; and a deck having a generally flat upper surface for supporting said notebook computer thereon, and second hinge means attached to each opposite end of said deck for foldably joining each said opposite end to said support arm and supporting said deck on said arm whereby said deck is supported by said arm at an inclined angle below said edge of said stationary body.

28. The apparatus according to claim 27, wherein said first hinge means is a support hinge having a removable hinge pin.

29. The apparatus according to claim 28, wherein said second hinge means is a buttress hinge operable through an arc of 90° between a folded position wherein an upper surface of said support arm is at a right angle to said upper surface of said deck and an open position wherein said upper surface of said support arm and said upper surface of said deck lie in a common plane.

30. The apparatus according to claim 27, wherein said deck includes a pair of deck leaves and a central buttress hinge joining said leaves and operable between an open position wherein said leaves form a flat planar support surface with said leaves abutted together and a folded position wherein said leaves are parallel to each other.

31. The apparatus according to claim 30, wherein said end hinges and central buttress hinge rotate in opposite directions in order to move between said folded and open positions.

32. The apparatus according to claim 31, wherein said end hinges and said central buttress hinge rotate about parallel axes.

33. The apparatus according to claim 23, wherein said support hinge between said hanger and said support arm is rotatable about an axis orthogonal to said end hinge.

34. A portable shelf apparatus for a notebook computer adapted to be mounted on a stationary body having an edge, the apparatus comprising:

a pair of folding supports each including an elongated support arm and a hanger for attaching the support to said edge and a support hinge between said hanger and said arm; and a deck having a generally flat upper surface and having opposite ends attached to said support arms for supporting said notebook computer thereon wherein each end of said deck is slidably attached to one of said support arms by an interlocking tongue and groove joint.

35. The apparatus according to claim 34, wherein said deck has a rectangular, flat upper surface and each end of said deck has a first downwardly protruding tongue extending along the length of said end and a second tongue protruding outwardly from and along the length of said first tongue.

36. The apparatus according to claim 35, wherein said each of said support arms has a pair of parallel intersecting longitudinal grooves therein complementary to said first and second tongues on said ends of said deck for slidably joining said support arms to said deck.

37. The apparatus according to claim 36, wherein said first and second tongues protrude orthogonally to each other.

38. The apparatus according to claim 37, wherein said support arm has another pair of intersecting longitudinal grooves therein, and an accessory device joined to said support arm adjacent to said deck.

39. The apparatus according to claim 38, wherein said accessory device is a flat platform for supporting a document, said platform having a pair of intersecting tongues protruding from and extending along one edge of said platform having a shape complementary to said another pair of intersecting longitudinal grooves in said support arm.

* * * * *